US008944306B2

(12) United States Patent
Gruber et al.

(10) Patent No.: US 8,944,306 B2
(45) Date of Patent: Feb. 3, 2015

(54) FORMING METAL PREFORMS AND METAL BALLS

(71) Applicant: International Business Machines Corporation, Armonk, NY (US)

(72) Inventors: Peter A. Gruber, Mohegan Lake, NY (US); Paul A. Lauro, Brewster, NY (US); Jae-Woong Nah, New York, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/058,257

(22) Filed: Oct. 20, 2013

(65) Prior Publication Data

US 2014/0041824 A1 Feb. 13, 2014

Related U.S. Application Data

(62) Division of application No. 13/371,430, filed on Feb. 11, 2012, now Pat. No. 8,561,880.

(51) Int. Cl.

| | |
|---|---|
| ***B23K 37/00*** | (2006.01) |
| ***B22D 29/02*** | (2006.01) |
| ***B22D 23/00*** | (2006.01) |
| ***B22D 25/02*** | (2006.01) |
| ***B22C 9/06*** | (2006.01) |
| ***B22D 21/02*** | (2006.01) |

(52) U.S. Cl.

CPC ..... *B22D 29/02* (2013.01); *B22D 23/00* (2013.01); *B22D 25/02* (2013.01); *B22C 9/061* (2013.01); *B22D 21/027* (2013.01)

USPC ..... 228/13; 228/41

(58) Field of Classification Search

None

See application file for complete search history.

(56) References Cited

U.S. PATENT DOCUMENTS

| | | | | | |
|---|---|---|---|---|---|
| 2,083,081 | A | | 6/1937 | Moll | |
| 3,193,888 | A | * | 7/1965 | Rochester | 164/432 |
| 3,309,892 | A | | 3/1967 | O'Connell et al. | |
| 3,888,745 | A | * | 6/1975 | Hojyo | 205/129 |
| 4,073,583 | A | * | 2/1978 | Teumer et al. | 399/307 |
| 4,372,369 | A | * | 2/1983 | Flemings et al. | 164/482 |
| 4,467,954 | A | * | 8/1984 | Brenneman | 228/117 |
| 4,607,683 | A | * | 8/1986 | Hamashima et al. | 164/463 |
| 4,793,401 | A | * | 12/1988 | Matsuoka et al. | 164/476 |
| 5,244,143 | A | | 9/1993 | Ference et al. | |
| 5,307,864 | A | * | 5/1994 | Arvedi et al. | 164/476 |
| 5,329,688 | A | * | 7/1994 | Arvedi et al. | 29/527.7 |
| 5,431,332 | A | | 7/1995 | Kirby et al. | |
| 5,735,452 | A | | 4/1998 | Yu et al. | |
| 5,796,065 | A | * | 8/1998 | Fujiyoshi et al. | 219/78.02 |
| 5,871,138 | A | * | 2/1999 | Shishido et al. | 228/102 |

(Continued)

FOREIGN PATENT DOCUMENTS

| | | | | |
|---|---|---|---|---|
| EP | 0081848 | A | * | 6/1983 |
| JP | 06-223943 | A | * | 8/1994 |

(Continued)

*Primary Examiner* — Kiley Stoner

(74) *Attorney, Agent, or Firm* — Louis J. Percello; Robert M. Trepp

(57) ABSTRACT

An apparatus for transferring metal solidified in blind cavities is described incorporating a first flexible tape having blind cavities, a second flexible tape having adhesive regions, rollers for guiding respective tapes and means for moving respective tapes. Also a conveyor belt having blind or through cavities, rollers and a vibration transducer or pressurized gas is described to release solidified metal in the cavities.

5 Claims, 7 Drawing Sheets

(56) References Cited

U.S. PATENT DOCUMENTS

| | | | | |
|---|---|---|---|---|
| 5,938,106 | A | 8/1999 | Pierson | |
| 5,972,159 | A * | 10/1999 | Uryu et al. | 156/706 |
| 6,056,190 | A | 5/2000 | Foulke et al. | |
| 6,056,191 | A | 5/2000 | Brouillette et al. | |
| 6,090,301 | A | 7/2000 | Mizukoshi et al. | |
| 6,153,505 | A | 11/2000 | Bolde et al. | |
| 6,231,333 | B1 | 5/2001 | Gruber et al. | |
| 6,234,382 | B1 | 5/2001 | Rischke et al. | |
| 6,332,569 | B1 | 12/2001 | Cordes et al. | |
| 6,340,630 | B1 | 1/2002 | Berger et al. | |
| 6,394,334 | B1 | 5/2002 | Brouillette et al. | |
| 6,527,158 | B1 | 3/2003 | Brouillette et al. | |
| 6,528,346 | B2 | 3/2003 | Ochiai et al. | |
| 6,618,939 | B2 * | 9/2003 | Uchibori et al. | 29/846 |
| 7,156,361 | B1 | 1/2007 | Akram | |
| 7,332,424 | B2 | 2/2008 | Belanger et al. | |
| 7,506,794 | B1 | 3/2009 | Cordes et al. | |
| 7,980,446 | B2 | 7/2011 | Buchwalter et al. | |
| 8,132,775 | B2 | 3/2012 | Goldmann | |
| 8,162,203 | B1 | 4/2012 | Gruber et al. | |
| 8,342,387 | B2 | 1/2013 | Gruber et al. | |
| 2002/0125402 | A1 | 9/2002 | Cordes et al. | |
| 2005/0263571 | A1 | 12/2005 | Belanger et al. | |
| 2006/0035454 | A1 | 2/2006 | Belanger et al. | |
| 2006/0280912 | A1 * | 12/2006 | Liang et al. | 428/173 |
| 2006/0289607 | A1 | 12/2006 | Buchwalter et al. | |
| 2007/0246516 | A1 | 10/2007 | Cordes et al. | |
| 2007/0246853 | A1 | 10/2007 | Chey et al. | |
| 2008/0164609 | A1 | 7/2008 | Gruber | |
| 2008/0272177 | A1 | 11/2008 | Cordes et al. | |
| 2009/0020590 | A1 | 1/2009 | Knickerbocker et al. | |
| 2009/0039142 | A1 | 2/2009 | Bezama et al. | |
| 2009/0072011 | A1 * | 3/2009 | Sakaguchi et al. | 228/245 |
| 2009/0072392 | A1 | 3/2009 | Dang et al. | |
| 2009/0093111 | A1 * | 4/2009 | Buchwalter et al. | 438/614 |
| 2009/0120999 | A1 | 5/2009 | Indyk et al. | |
| 2009/0176321 | A1 | 7/2009 | Park | |
| 2009/0302096 | A1 | 12/2009 | Budd et al. | |
| 2009/0309219 | A1 | 12/2009 | Gruber | |
| 2010/0001045 | A1 | 1/2010 | Cordes et al. | |
| 2010/0054788 | A1 * | 3/2010 | Mukai et al. | 399/70 |
| 2010/0116871 | A1 | 5/2010 | Gruber et al. | |
| 2010/0175848 | A1 * | 7/2010 | Kagehira et al. | 164/428 |
| 2011/0033611 | A1 * | 2/2011 | Matsuhashi | 427/123 |
| 2011/0092066 | A1 | 4/2011 | Mackay | |
| 2011/0103842 | A1 * | 5/2011 | Hayashi et al. | 399/253 |
| 2011/0127312 | A1 | 6/2011 | Gruber et al. | |
| 2011/0158676 | A1 * | 6/2011 | Nakaya et al. | 399/94 |
| 2012/0045257 | A1 * | 2/2012 | Mizoguchi et al. | 399/302 |
| 2012/0132694 | A1 | 5/2012 | Buchwalter et al. | |
| 2012/0138769 | A1 | 6/2012 | Dang et al. | |
| 2012/0193833 | A1 | 8/2012 | Budd et al. | |
| 2012/0273155 | A1 | 11/2012 | Gruber et al. | |
| 2012/0312457 | A1 * | 12/2012 | Hosoe | 156/182 |
| 2013/0233480 | A1 * | 9/2013 | Na et al. | 156/249 |

FOREIGN PATENT DOCUMENTS

| | | | |
|---|---|---|---|
| JP | 10-104434 | A * | 4/1998 |
| JP | 61-143779 | A * | 7/2001 |
| JP | 2010-033793 | A * | 2/2010 |

* cited by examiner

FORMING METAL PREFORMS AND METAL BALLS

CROSS REFERENCED TO A RELATED APPLICATION

This application is cross referenced to U.S. patent application Ser. No. 13/371,431 filed on even date herein which issued as U.S. Pat. No. 8,408,448 on Apr. 2, 2013 entitled "FORMING CONSTANT DIAMETER SPHERICAL METAL BALLS" which is assigned to the assignee herein and directed to an apparatus and method for forming a plurality of constant diameter spherical metal balls utilizing injection molded metal and unconstrained metal reflow and to divisional U.S. patent application Ser. No. 13/846,158 filed Mar. 18, 2013 which is directed to an apparatus for forming metal solder balls and/or metal balls and to an apparatus for transferring metal solidified in cavities in a flexible tape from the tape.

BACKGROUND

The present invention relates to tools and processes for forming metal preforms, metal shapes and metal balls useful in microelectronics and more specifically, to injection molded solder and flexible molds which constrain some metal reflow to form metal performs, metal shapes and solder balls which are released or extracted from molds and collected.

BRIEF SUMMARY OF THE INVENTION

In accordance with the present invention, a method for forming metal balls is described comprising filling cavities in a flexible mold with molten metal in an environment inducing surface tension sphering and removing the metal balls from the cavities by mechanical means.

The present invention further describes a method for forming metal shapes comprising:

selecting a substrate capable of bending to a predetermined radius of curvature;

forming a plurality of cavities in the substrate material;

the plurality of cavities having a first shape including cavity walls, the cavities providing a change of shape from the first shape to a second shape upon bending the substrate to a predetermined radius of curvature;

filling the plurality of cavities with molten metal;

cooling the molten metal in said plurality of cavities to form a solid metal of a first shape in respective cavities of the plurality of cavities;

heating the solid metal in the respective cavities in a flux or an atmosphere to reduce or substantially reduce any metal oxides on surfaces of the solid metal;

reflowing the solid metal in the respective cavities;

cooling the reflowed metal to form a solid metal of a second shape in the respective cavities; and bending the substrate to said predetermined radius of curvature to form the second shape of the plurality of cavities to cause a break in the contact of the solid metal of a second shape in the respective cavities from portions of the respective cavity walls whereby the solid metal of the second shape is released from contact in the respective cavities.

Apparatus for transferring metal solidified in blind cavities in an upper surface of a first flexible tape comprising:

first and second spaced apart rollers for directing a lower surface of the first flexible tape there over;

a third roller positioned between the first and second rollers for supporting the lower surface of the first flexible tape, fourth and fifth spaced apart rollers for directing a lower surface of a second flexible tape thereover, the second flexible tape having an upper surface having adhesive regions thereon;

the fourth and fifth rollers positioned to position the second flexible tape adjacent the first flexible tape;

a sixth roller positioned between the fourth and fifth rollers to press against the lower surface of the second flexible tape to press the upper surface of the second flexible tape against the upper surface of the first flexible tape;

means for moving the first flexible tape over the first through third rollers in a first direction and at a first speed, and means for moving the second flexible tape over the fourth through sixth rollers in the first direction at the first speed whereby adhesive regions on the second flexible tape adhere to the metal solidified in the blind cavities in the first flexible tape and wherein the second flexible tape with the metal passes over the fifth roller and separates from the first flexible tape which passes over the second roller.

The present invention further describes apparatus for transferring metal solidified in cavities in an upper surface of a flexible tape comprising:

first and second spaced apart rollers for directing a lower surface of the flexible tape there over;

the second roller positioned to guide the upper surface of the flexible tape to face towards ground, a transducer coupled to the first flexible tape after the first and second rollers for vibrating the flexible tape whereby the metal in the cavities are vibrated loose from contact and moves away from the flexible tape with the aid of the vibration and gravity.

Apparatus for transferring metal solidified in through-hole a flexible tape comprising:

first and second spaced apart rollers for directing a surface of the flexible tape thereover;

a pressurized gas actuator positioned for directing pressurized gas on a surface of the flexible tape and through-hole cavities whereby the metal in the through-hole cavities is loosened and moves away from the flexible tape with aid of the pressurized gas.

BRIEF DESCRIPTION OF THE SEVERAL VIEWS OF THE DRAWINGS

These and other features, objects, and advantages of the present invention will become apparent upon consideration of the following detailed description of the invention when read in conjunction with the drawing in which.

DETAILED DESCRIPTION

Figure 1:
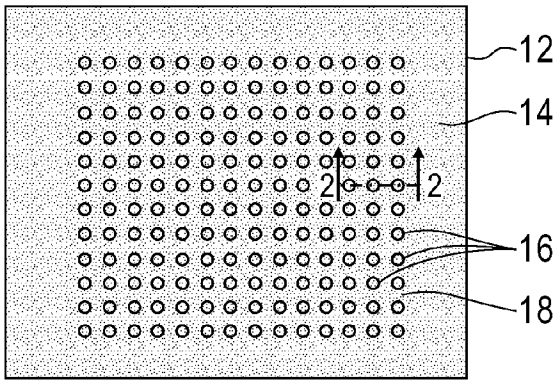
FIG. 1 shows a flexible mold with blind cavities.

Referring now to the drawing, FIG. 1 shows flexible substrate, mold or sheet 12 which may be planar or flat comprising a polymer such as a polyimide, polyamide, a glass, a metal, a graphite or a ceramic capable of withstanding 400° C. and which can bend or flex elastically about an axis from a planar or flat position to a predetermined radius of curvature, for example, in the range from infinity to plus or minus 0.025 mm or from 4t to greater than 4t where t is the mold or sheet thickness. Flexible mold 12 may have an upper surface 14 and a thickness in the range from 0.012 mm to 12.7 mm. Flexible mold 12 may have a plurality of cavities 16 which may be arranged in a two dimensional array 18 such as a rectangular or square array with rows and columns spaced apart in the range from 0.002 nm to 12.7 mm, respectively. Plurality of cavities 16 may have a first shape 20 shown in FIG. 2 such as a hemisphere, a flattened hemisphere, or other shape including cavity bottom walls 26 and side walls 28. Plurality of cavities 16 may change elastically from a first shape 20 to another shape such as a second shape at times flexible mold 12 is bent or flexed to a predetermined radius of curvature.

Figure 2:
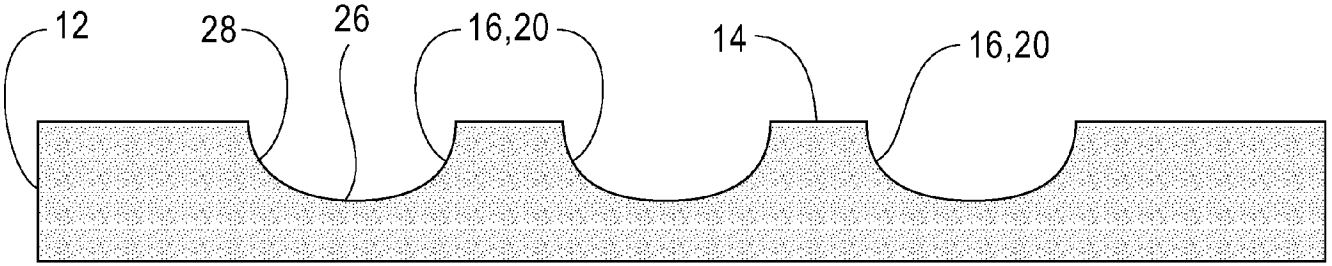
FIG. 2 is a cross-section view along the lines 2-2 of FIG. 1.

FIG. 2 is a cross-section view along the lines 2-2 of FIG. 1. In FIG. 2, plurality of cavities 16 have a bottom wall 26 and are blind cavities i.e. not a through-hole cavity since there is no opening at the bottom. Plurality of cavities 16 are spaced apart on a center-to-center spacing in the range from 0.002 mm to 12.7 mm to enable flexible mold material between cavities 16 to physically support or hold first shape 20 of cavities 16 when flexible mold 12 is not flexed. Plurality of cavities 16 may have an aspect ratio, depth to width ratio, in the range from ⅓ to ⅔ where the shape is a hemisphere or flattened hemisphere. The depth of cavity 16 may be in the range from ⅓ to 1 and more preferably ½ the depth of the final metal (solder) ball. The diameter of plurality of cavities 16 may be in the range from 0.0025 mm to 0.89 mm.

Figure 3:
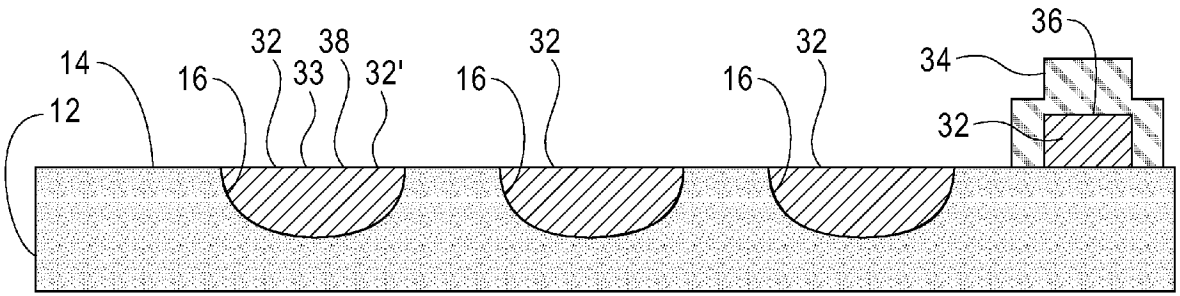
FIG. 3 is a cross-section view along the lines 2-2 of FIG. 1 after blind cavities in the flexible mold are filled with molten solder using a tool also shown.

FIG. 3 is a cross-section view along the lines 2-2 of FIG. 1 after cavities 16 in flexible mold 12 have been filled with molten solder 32 by way of injection molding solder using tool 34. Tool 34 which has a reservoir 36 of solder sweeps solder along upper surface 14 into cavities 16 and leaves an upper surface 33 of molten solder 32 in plurality of cavities 16 coplanar with upper surface 14 of flexible mold 12. If molten solder 32 is in an oxygen environment, a metal oxide or oxide material 38 will form on upper surface 33. Oxide material 38 may be a uniform layer with a smooth surface and may be thicker than 0.01 μm. Molten solder 32 is cooled below the melting temperature of molten solder 32 to form solid solder 32'. Molten solder 32 may be selected from the group consisting of Sn, In, Sn—In, Sn—Pb, Sn—Au, Sn—Ag, Sn—Cu, Ag—Bi, Sn—Ag—Cu, Sn—Ag—Bi, Sn—Ag—Cu—Zn, Sn—Ag—Cu—Bi, Sn—Ag—Cu—Pd, Sn—Ag—Cu—Ti, Sn—Ag—Cu—Al, Sn—Ag—Cu—Sb, Sn—Ag—Cu—Ce, Sn—Ag—Cu—Ge, Sn—Ag—Cu—Mn, Sn—Ag—Cu—La and combinations thereof.

Figure 4:
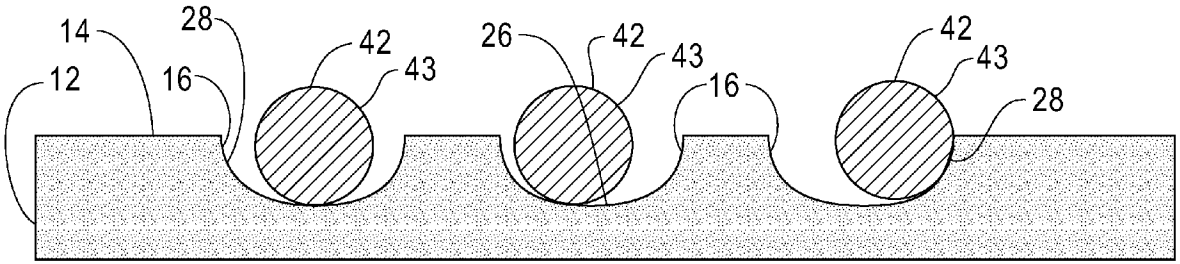
FIG. 4 is a cross-section view along the lines 2-2 of FIG. 1 after blind cavities in the flexible mold are filled with molten solder as shown in FIG. 3 and after reflow of solder with a flux.

FIG. 4 is a cross-section view along the lines 2-2 of FIG. 1 after blind cavities in flexible mold 12 are filled with molten solder 32 as shown in FIG. 3 and after reflow of solid solder 32' by way of heating in a liquid or gaseous flux environment that eliminates oxide material 38 on upper surface 33. A flux is a reducing agent designed to help reduce or return oxidized metals to their metallic state. One gaseous flux suitable for solder is formic acid (HCOOH) diluted with nitrogen in a bubbler. Another gaseous flux may be forming gas which is a mixture of hydrogen ($H_2$) and an inert gas usually nitrogen ($N_2$) that works well to reduce oxides on metal surfaces 33 to form metal and water. $H_2$ may be in the range from 8 to 25 volume percent in an inert gas. Another gaseous flux may be hydrogen ($H_2$) at 100 percent. A liquid flux, if applied, is removed in a subsequent cleaning step. By raising the temperature of solid solder 32' above the melting point and with oxide material 38 removed or eliminated, the surface tension of molten solder 32 will increase and reflow to form spherical, near spherical, or substantially spherical balls 42 in plurality of cavities 16 as shown in FIG. 4. As shown in FIG. 4, substantially spherical balls 42 remain in contact with the bottom wall 26 or side walls 28 of plurality of cavities 16. Flexible mold 12 should comprise materials which are hydrophobic and which solder does not wet. While solder does not wet glass or polyimide, solder does form a bond with glass or polyimide that is surprisingly difficult to break causing near spherical solder balls. Further, the formation of or retention of solder oxides should be minimized, since solder oxides make spherical balling of solder much more difficult due to reduced surface tension. Further, metal oxides of solder on surface 43 of spherical or near spherical balls 42 may bond to bottom wall 26 and sidewalls 28 of cavities 16 causing near spherical solder balls.

The uniform size, volume or dimensional tolerance of spherical, near or substantially spherical metal balls 42 such as the volume and diameter corresponds to the uniform size of cavities 16 in the flexible mold 12 which determines the volume of metal in substantially spherical metal balls 42. The molten metal in the cavities 16 and reflow of the molten metal is in contact and constrained by the cavity walls 26 and 28. Cavity walls 26 and 28 where contacted is a constraining force on the molten metal and any metal oxides thereon. The constraining forces by cavity 16 and gravity will act to deform metal balls 42 and are counteracted by the force or magnitude of the molten metal surface tension.

The cross section or diameter dimensions of substantially spherical metal balls 42 may be different or out of round from one another and within a respective metal ball 42 depending on the cross section taken. The spherical metal ball out of round dimensions of substantially spherical metal balls 42 are affected by tolerances of the cavity 16 dimensions (mentioned above), surface tension of the molten metal, supporting cavity wall 26 and 28 contact area (constraining force) with ball 42 and or metal oxide skin, whether cavity walls 26 and 28 are hydrophobic or hydrophilic or under other contact forces, weight of ball 42 and specific gravity of metal ball 42. Surface tension of metal ball 42 is influenced by metal composition, any metal oxides in or on the surface 43 of near or substantially spherical metal balls 42 and flux. The uniform size or volume tolerance of spherical or substantially spherical metal balls 42 may be less than 16 percent and preferably less than 7 percent. The diameter or cross section dimensional tolerance of spherical, near or substantially spherical metal balls 42 may be less than 5 percent and preferably less than 2.5 percent.

Figure 5:
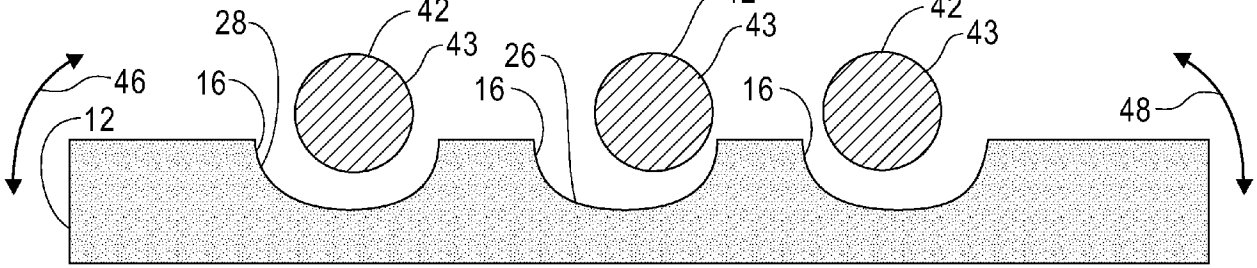
FIG. 5 is a cross-section view along the lines 2-2 of FIG. 1 after blind cavities in the flexible mold are filled with molten solder as shown in FIG. 3, after reflow of solder with flux, as shown in FIG. 4 and after flexing the flexible mold to extract solder balls.

FIG. 5 is a cross-section view along the lines 2-2 of FIG. 1 as shown in FIG. 4 after flexing mold 12 to extract spherical or near spherical balls 42. A mechanical means such as a roller, cylinder or actuator may bend or flex flexible mold or sheet 12 to a predetermined (positive and/or negative) radius of curvature as shown by arrows 46 and 48. The shape of plurality of cavities 16 change elastically due to bending flexible mold or sheet 12 which breaks the contact of spherical or near spherical balls 42 with bottom wall 26 and side walls 28 of cavities 16 thereby releasing solder balls 42. Flexible mold 12 may be turned upside down during flexing to use the force of gravity to separate spherical balls 42 from flexible mold 12. Once surface 43 of spherical or near spherical balls 42 are broken free of contact or bond with bottom wall 26 and side walls 28, various methods may be used to collect the loose spherical or near spherical balls 42 into a container including gravity as mentioned above, vacuuming, blowing and/or sweeping.

Figure 6:
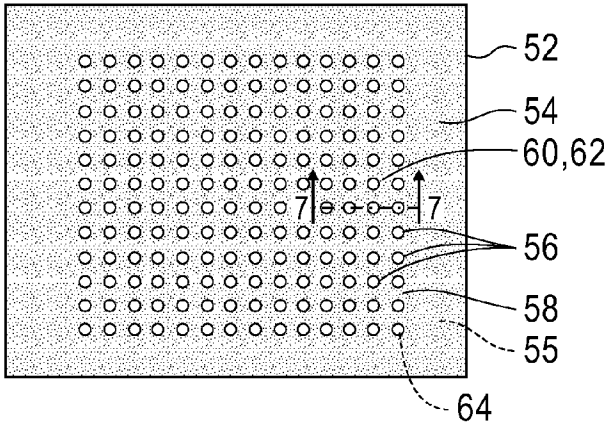
FIG. 6 shows a flexible mold with through hole cavities.

FIG. 6 shows a flexible, substrate, mold or sheet 52 which may be planar or flat having an upper surface 54, a lower surface 55 and a plurality of cavities 56. Plurality of cavities 56 may be arranged in a two dimensional array 58 such as a rectangular or square array with rows and columns spaced apart in the range from 0.002 mm to 12.7 mm, respectively. Plurality of cavities 56 may have a first shape 60 shown in FIG. 7 having an upper opening 62 in surface 54 and a lower opening 64 in lower surface 55 to form through-holes through flexible mold 52. Flexible mold 52 may be a sheet of polyimide of constant thickness capable of withstanding 400° C. and which can bend or flex to a predetermined radius of curvature in the range from plus or minus infinity to 0.025 mm or 4t to greater than 4t where t is the mold or sheet thickness. Plurality of cavities 56 may change elastically from a first shape 60 to another shape such as a second shape at times flexible mold 52 is bent elastically to a predetermined radius of curvature.

Figure 7:
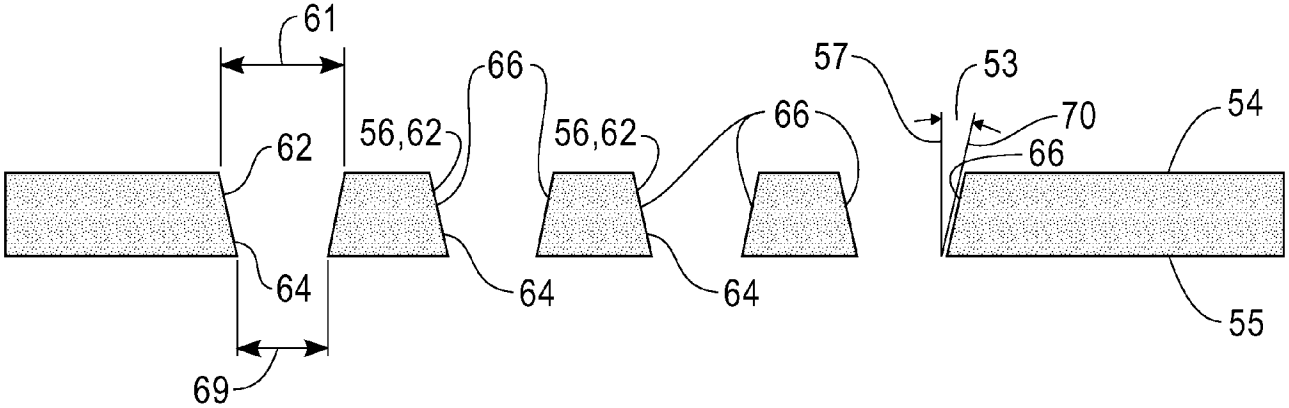
FIG. 7 is a cross-section view along the lines 7-7 of FIG. 6.

FIG. 7 is a cross-section view along the lines 7-7 of FIG. 6. Plurality of cavities 56 are shown with through-holes having upper opening 62 which is circular having a diameter shown by arrow 61 and lower opening 64 which is circular having a diameter shown by arrow 69. Lower opening 64 is smaller than upper opening 62. Plurality of cavities 56 have sidewalls 66 which are shown as a truncated portion of a cone and/or may be cylindrical. Cavities 56 may be space apart on a center-to-center spacing in the range from 0.002 mm to 12.7 mm to enable flexible mold material there between to adequately support first shape 60 of plurality of cavities 56 when not being flexed. Plurality of cavities 56 may be formed with an ultra violet laser (UV) and/or eximer laser and may have a wall taper of 4° to 10° shown by arrow 53 between a vertical axis 57 and reference line 70.

Figure 8:
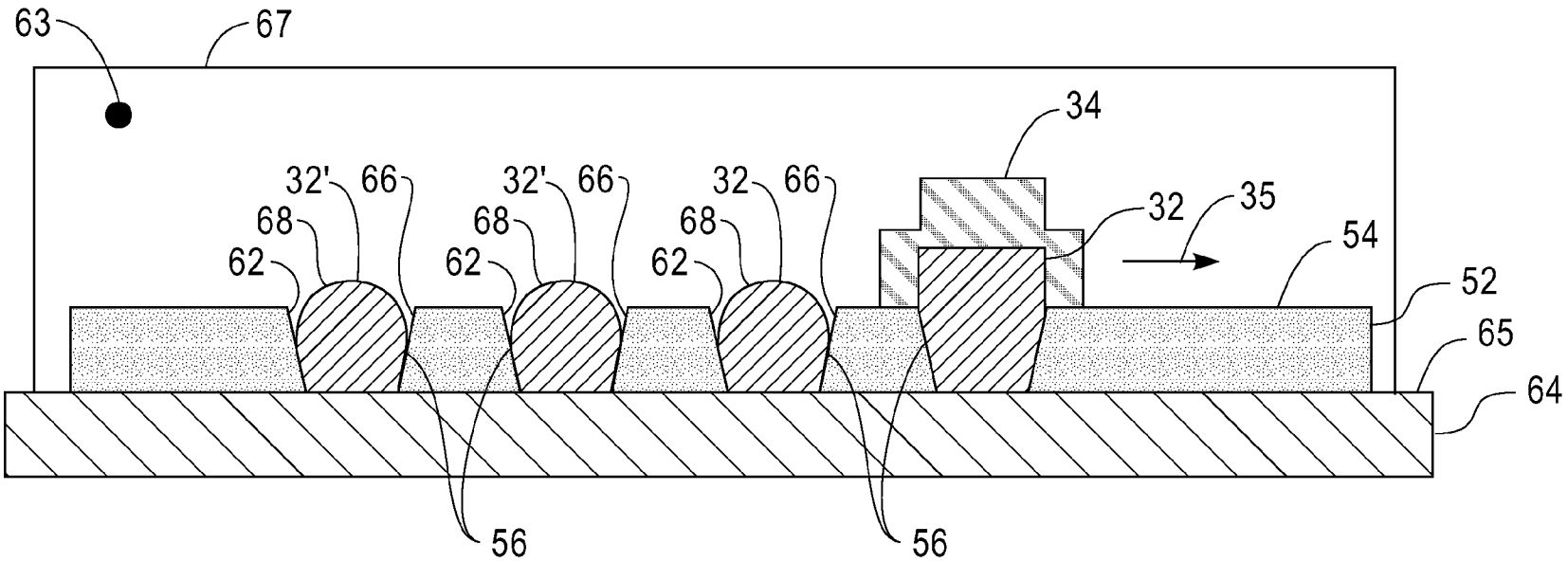
FIG. 8 is a cross-section view along the lines 7-7 of FIG. 6 after through hole cavities in the flexible mold are filled with molten metal (solder) using a tool also shown and after the molten metal (solder) is solidified in a $N_2$ environment.

FIG. 8 is a cross-section view along the lines 7-7 of FIG. 6 after molten solder 32 is injected into respective cavities 56, for example, by injection molding solder and solidified in a low oxygen and $N_2$ or other inert gas environment 63. Flexible mold 52 is shown positioned on upper surface 65 of substrate 64. Substrate 64 provides support to flexible mold 52 and a temporary lower surface to cavities 56 to permit cavities 56 to be filled by way of injection molding solder with molten solder 32 from solder tool 34 positioned on upper surface 54 of flexible mold 52. Solder tool 34 moves in a direction to the right shown by arrow 35 in FIG. 8. Housing 67 is positioned over flexible mold 52 and functions to maintain a low oxygen and $N_2$ or other inert gas environment 63 above cavities 56 and molten solder 32. With a low oxygen atmosphere in the range from 10 to 1000 ppm, the upper surface of molten solder 32 is free or substantially free of oxide material especially at the location where upper surface 54 and sidewall 66 meet, join or intersect at the edge of opening 62 of cavities 56. The edge of opening 62 is initially in contact with molten solder 32 but is free of metal oxide permitting molten solder 32 to pull away from upper surface 54 and sidewall 66 and ball up due to the surface tension of molten solder 32. As shown in FIG. 8, molten solder 32 in cavities 56 have a rounded upper surface 68 as opposed to a flat surface 33 shown in FIG. 3. Molten solder 32 is cooled below the melting point of molten solder 32 to solidify in cavities 56 as solid solder 32'.

Figure 9:
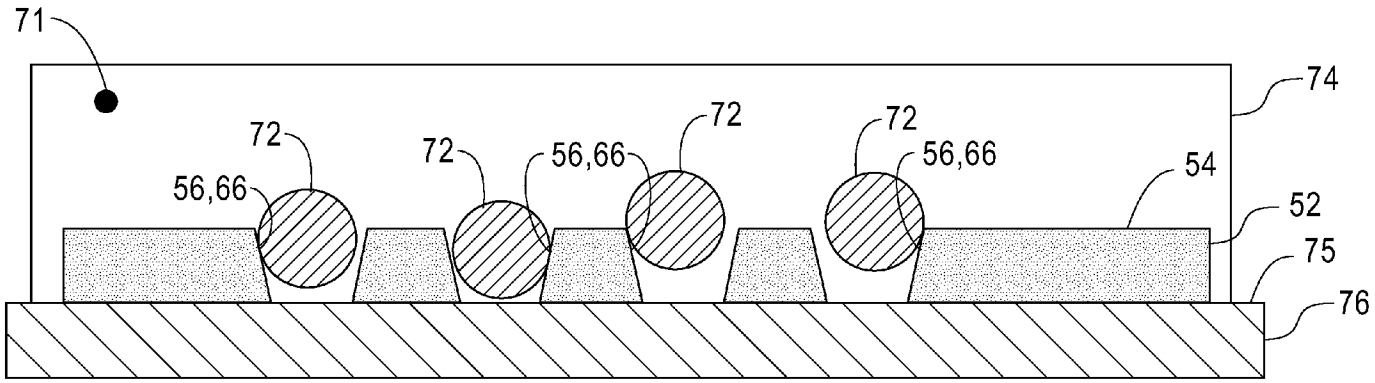
FIG. 9 is a cross-section view along the lines 7-7 of FIG. 6 after through-hole cavities in the flexible mold are filled with molten metal (solder) and after the molten metal (solder) is solidified in a $N_2$ environment as shown in FIG. 8 and after metal reflow in the cavities in a gas environment of formic acid, hydrogen ($H_2$) or hydrogen ($H_2$) and nitrogen ($N_2$).

FIG. 9 is a cross-section view along the lines 7-7 of FIG. 6 after molten solder 32 is injected into cavities 56 and solidified in environment 63 as shown in FIG. 8 and after reflow in a gas environment 71 of formic acid, forming gas of for example nitrogen ($N_2$) and hydrogen ($H_2$) or 100 percent $H_2$. Molten solder 32 in flexible cavities 56 in FIG. 8 are shown as spherical or near spherical solder balls 72 in contact with sidewalls 66 in FIG. 9. Housing 74 is shown mounted on the upper surface 75 of substrate 76. Housing 74 functions to provide a low oxygen atmosphere in the range from 10 to 1000 ppm to prevent metal oxides from forming on solder balls 72 and/or to remove or substantially remove metal oxides from the surface of solder balls 72 by means of gas environment 71 which may comprise formic acid, forming gas of for example nitrogen ($N_2$) and hydrogen ($H_2$) or 100 percent $H_2$. Formic acid, expressed as HCOOH, may be provided by injecting nitrogen into a bubbler containing formic acid which is released through an outlet port to provide a gas environment 71 comprising nitrogen enriched with formic acid. Spherical or near spherical solder balls 72 may have no or substantially no metal oxide skin which if present is a uniform layer with a smooth surface on solder balls 72 where the thickness of the layer is less than 1 micron. Solder balls 72 should have no or substantially no metal oxide skin so there is minimum adhesion between solder balls 72 and sidewall 66.

Figure 10:
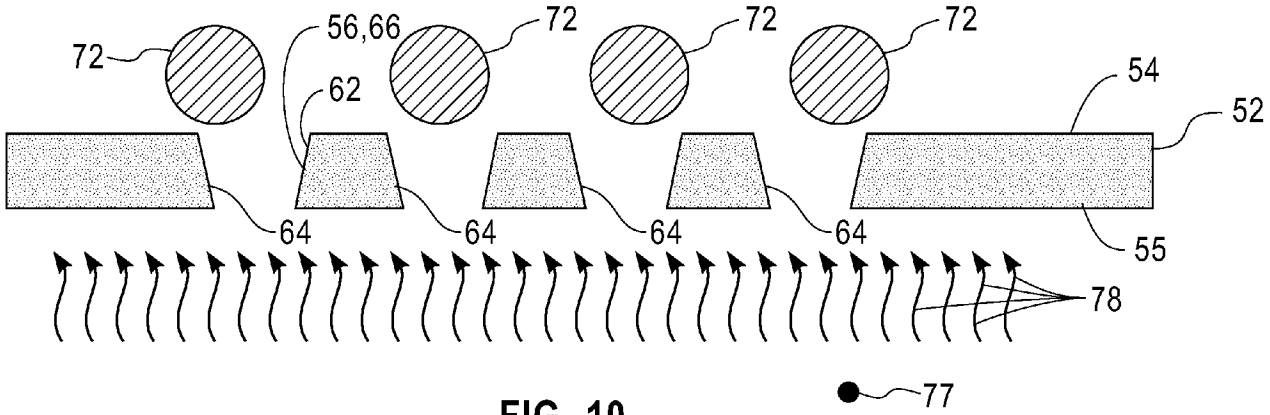
FIG. 10 is a cross-section view along the lines 7-7 of FIG. 6 after through-hole cavities in the flexible mold are filled with molten metal (solder) and after the molten metal (solder) is solidified in a $N_2$ environment as shown in FIG. 8 and after metal reflow in the cavities in a gas environment of formic acid, hydrogen ($H_2$) or hydrogen ($H_2$) and nitrogen ($N_2$) as shown in FIG. 9 and after blowing gas on through-hole cavities on one side of the flexible mold to extract metal preforms or metal balls.

FIG. 10 is a cross-section view along the lines 7-7 of FIG. 6 after molten solder 32 is injected into cavities and solidified in environment 63 as shown in FIG. 8, after reflow in a gas environment 71 of formic acid, forming gas of for example hydrogen ($H_2$) and nitrogen ($N_2$) and 100 percent hydrogen ($H_2$) as shown in FIG. 9 and after blowing gas 77 on through-holes on lower side 55 of flexible mold 52 to loosen and extract spherical solder balls 72. In FIG. 10, housing 74 and substrate 64 shown in FIG. 9 have been removed. Air or gas 77 such as $N_2$ is blowing at lower surface 55 of flexible mold 52 and into lower openings 64 of cavities 56 as shown by arrows 78 to easily loosen and remove spherical or near spherical solder balls 72 from contact with sidewalls 66 and from through-hole cavities 56.

Figure 11:
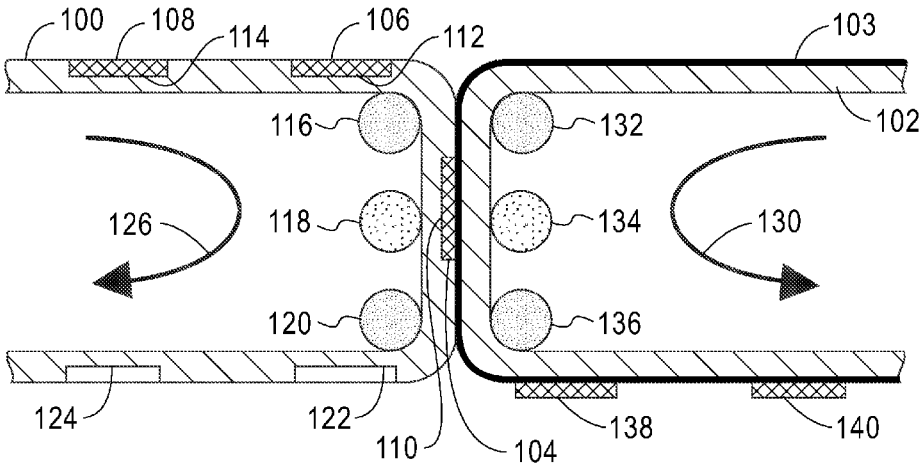
FIG. 11 is a schematic view of a conveyor belt or tape and an adhesive tape which are brought together for transfer of non-reflowed metal (solder) preforms from blind cavities on the conveyor belt or tape to the adhesive tape.

FIG. 11 is a schematic view of conveyor belt or tape 100 and an adhesive tape 102 which are brought together for extraction or transfer of non-reflowed metal (solder) 104, 106 and 108 from blind cavities 110, 112 and 114 on conveyor belt or tape 100 to adhesive tape 102. Conveyor belt or tape 100 passes over rollers 116, 118 and 120. Conveyor belt or tape 100 also has empty blind cavities 122 and 124. Conveyor belt or tape 100 moves in a clockwise direction shown by arrow 126. Adhesive tape 102 moves in a counter clockwise direction as shown by arrow 130. Adhesive tape 102 passes over rollers 132, 134 and 136. Adhesive tape 102 has an upper surface having adhesive regions or an adhesive layer 103 thereon as part of adhesive tape 102. Adhesive tape 102 is pressed against non-reflowed metal (solder) 104 by roller 134 which may be soft or compressible to apply pressure over a larger area against non-reflowed metal (solder) 104 in cavity 110 in conveyor belt 100 and roller 118 which may be hard or non-compressible. Non-reflowed metal (solder) 104 was loosened by passing over roller 116. Conveyor belt or tape 100 and adhesive tape 102 move in the same direction and at the same speed when passing between rollers 118 and 134. Adhesive tape 102 adheres to an upper surface of non-reflowed metal (solder) 104 and extracts non-reflowed metal (solder) 104 from blind cavity 110 as conveyor belt or tape 100 separates from adhesive tape 102 via rollers 120 and 136. Previously transferred non-reflowed metal (solder) 138 from blind cavity 122 and non-reflowed metal (solder) 140 from blind cavity 124 are shown adhered to adhesive tape 102.

Figure 12:
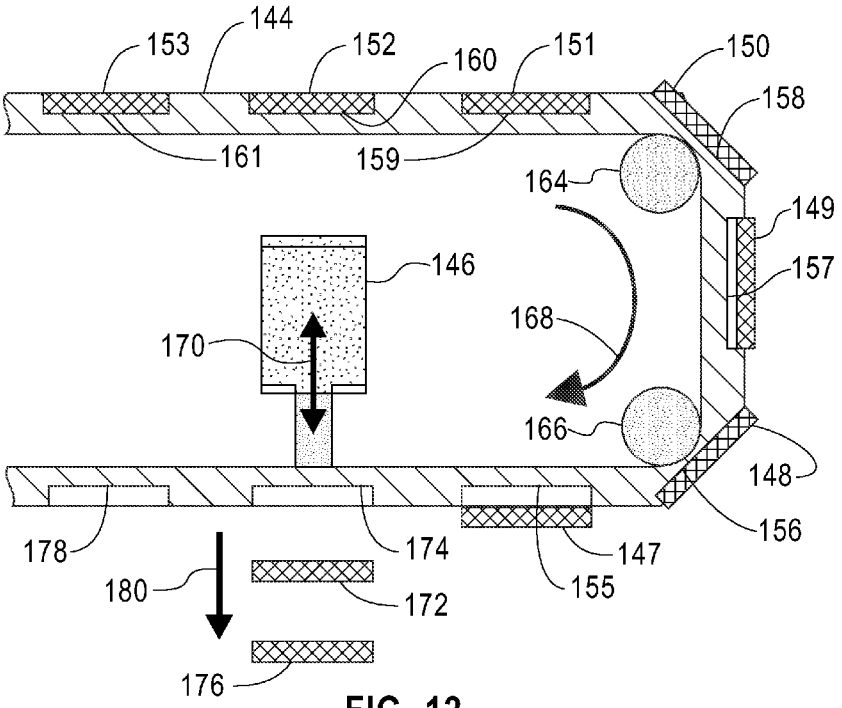
FIG. 12 is a schematic view of a conveyor belt or tape and a vibration transducer for extraction of non-reflowed metal (solder) preforms from blind cavities on the conveyor belt or tape.

FIG. 12 is a schematic view of a conveyor belt or tape 144 and a vibration transducer 146 for extraction of non-reflowed metal (solder) 147-153 from blind cavities 155-161, respectively, on conveyor belt or tape 144. Conveyor belt 144 passes over rollers 164 and 166 and moves in a clockwise direction shown by arrow 168. Non-reflowed metal (solder) 148 and 150 are initially loosened when passed over rollers 164 and 166 as conveyor belt or tape 144 moves. Vibration transducer 146 moves up and down transverse to or against conveyor belt or tape 144 as shown by arrow 170 to loosen and remove non-reflowed solder 172 from blind cavity 174 and non-reflowed metal (solder) 176 from blind cavity 178 as conveyor belt or tape 144 moves passed vibration transducer 146. Non-reflowed solder 172 and 176 move away from conveyor belt or tape 144 as shown by arrow 180 due to vibration or motion from vibration transducer 146 and by gravity.

Figure 13:
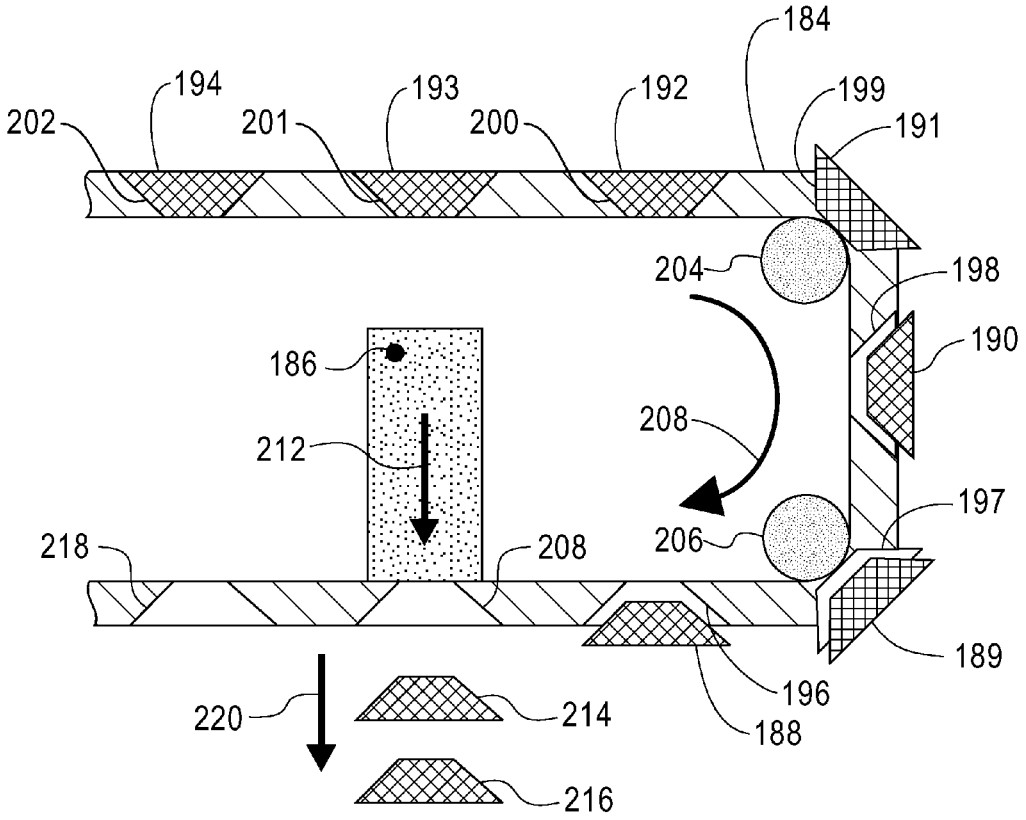
FIG. 13 is a schematic view of a conveyor belt or tape and a pressurized gas stream for extraction of non-reflowed metal (solder) preforms from through-hole cavities on the conveyor belt or tape.

FIG. 13 is a schematic view of a conveyor belt or tape 184 and pressurized gas 186 for extraction of non-reflowed metal (solder) preforms 188-194 from through-hole cavities 196-202, respectively, on conveyor belt or tape 184. Conveyor belt 184 passes over rollers 204 and 206 and moves in a clockwise direction show by arrow 208. Non-reflowed metal (solder) preforms 189 and 191 are initially loosened when passed over rollers 204 and 206 as conveyor belt or tape 184 moves. Pressurized gas 186 impinges against through-hole cavity 208 in conveyor belt or tape 184 as shown by arrow 212 to loosen and remove non-reflowed metal (solder) 214 from through-hole cavity 208 and non-reflowed metal (solder) 216 from through hole cavity 218. Non-reflowed metal (solder) 214 and 216 move away from conveyor belt or tape 184 as shown by arrow 220 due to pressurized gas 186 and by gravity.

In FIGS. 1-13, the structures therein are not drawn to scale.

While there has been described and illustrated an apparatus and methods for forming metal (solder) preforms, metal shapes and metal (solder) balls using flexible molds with either blind or through-hole cavities, injection molded metal such as solder, and in the case of solder balls, a liquid flux or a gas environment to reduce or remove metal oxides prior to or during metal or solder reflow to induce surface tension sphering of metal or solder balls, it will be apparent to those skilled in the art that modifications and variations are possible without deviating from the broad scope of the invention which shall be limited solely by the scope of the claims appended hereto.

What is claimed is:

1. Apparatus for transferring metal solidified in blind cavities comprising:

a first flexible tape having an upper surface having said blind cavities;

first and second spaced apart rollers for directing a lower surface of said first flexible tape there over;

a third roller positioned between said first and second rollers for supporting said lower surface of said first flexible tape;

a second flexible tape;

fourth and fifth spaced apart rollers for directing a lower surface of said second flexible tape there over, said second flexible tape having an upper surface having adhesive regions thereon;

said fourth and fifth rollers positioned with respect to said first and second rollers to position said second flexible tape adjacent said first flexible tape;

a sixth roller positioned between said fourth and fifth rollers to press against said lower surface of said second flexible tape to press said adhesive regions on said upper surface of said second flexible tape against said upper surface of said first flexible tape;

said first flexible tape adapted for coupling to a conveying means for moving said first flexible tape in a first direction and at a first speed whereby said first flexible tape moves over said first through third rollers in said first direction and at said first speed; and said second flexible tape adapted from coupling to a means for moving said second flexible tape in said first direction and at said first speed whereby said second flexible tape moves over said fourth through sixth rollers in said first direction and at said first speed whereby said adhesive regions on said second flexible tape adhere to said metal solidified in said blind cavities in said first flexible tape and wherein said second flexible tape with said metal passes over said fifth roller and separates from said respective blind cavities in said first flexible tape which passes over said second roller.

2. The apparatus of claim 1 wherein said metal solidified in said blind cavities has a flat upper surface.

3. The apparatus of claim 1 wherein said third roller is non-compressible.

4. The apparatus of claim 1 wherein said sixth roller is compressible to apply pressure over an area against said metal solidified in said blind cavities.

5. The apparatus of claim 1 wherein said third roller is positioned opposite said sixth roller to support said lower surface of said first flexible tape at times said first flexible tape receives pressure from said sixth roller.

* * * * *